US005979565A

United States Patent [19]

Wicks et al.

[11] Patent Number: 5,979,565

[45] Date of Patent: Nov. 9, 1999

[54] EMERGENCY VENTILATION SYSTEM FOR BIOLOGICAL/CHEMICAL CONTAMINATION

[76] Inventors: Edward A. Wicks, 11 W. Redding Rd., Danbury, Conn. 06810; Kenneth M. Berry, 125 Maple Ave., Wellsville, N.Y. 14895

[21] Appl. No.: 09/261,688

[22] Filed: Mar. 3, 1999

[51] Int. Cl.[6] ..... A62B 18/00; A62C 31/00

[52] U.S. Cl. ..... 169/17; 169/5; 239/270

[58] Field of Search ..... 169/54, 56, 57, 169/5, 7, 42, 19, 20, 37, 14, 16, 17, 48, DIG. 1; 239/270

[56] References Cited

U.S. PATENT DOCUMENTS

| | | | |
|---|---|---|---|
| 3,834,462 | 9/1974 | Orloff et al. | 169/17 |
| 3,893,624 | 7/1975 | Thompson | 239/107 |
| 4,134,457 | 1/1979 | O'Reilly | 169/16 |
| 4,234,044 | 11/1980 | Hollan et al. | 169/14 |
| 4,366,865 | 1/1983 | Makibbin | 169/16 X |
| 4,380,187 | 4/1983 | Wicks . | |
| 5,172,767 | 12/1992 | Turner et al. | 169/19 X |
| 5,720,659 | 2/1998 | Wicks . | |
| 5,862,867 | 1/1999 | Adnersson | 169/71 |

*Primary Examiner*—Andres Kashnikow
*Assistant Examiner*—Sean P. O'Hanlon
*Attorney, Agent, or Firm*—Robert J. Harter

[57] ABSTRACT

A dual-emergency response system includes a common supply line that selectively conveys a fire extinguishing fluid to extinguish a fire and conveys life-sustaining air to displace air contaminated by biological or chemical toxins. A valve that distinguishes between the fire extinguishing fluid and the life-sustaining air opens to convey the air, but closes to prevent the fire extinguishing fluid from escaping. The valve is installed alongside an overhead spray nozzle of a fire sprinkler system.

20 Claims, 6 Drawing Sheets

EMERGENCY VENTILATION SYSTEM FOR BIOLOGICAL/CHEMICAL CONTAMINATION

BACKGROUND OF THE INVENTION

1. Field of the Invention

The subject invention generally pertains to ventilation systems and more specifically to an emergency system for counteracting biological or chemical contamination of the air inside of a building.

2. Description of Related Art

At times, the breathable air within a building can become contaminated with biological or chemical toxins. This can occur naturally within a building's conventional HVAC system (heating, ventilating, and air conditioning system), or can be caused intentionally by terrorists and others employing chemical or biological warfare. Since the source of contamination can exist and even originate in the building's existing ductwork, using the ductwork may be ineffective and even detrimental in attempting to clear the air.

However, providing a second ventilation system of ductwork that is designated specifically for such emergencies can be expensive and difficult to retrofit in existing buildings. Moreover, such an emergency ductwork system may also be subject to contamination as well.

Some emergency ventilation systems, as disclosed in U.S. Pat. Nos. 4,380,187 and 5,720,659, use a building's existing bathroom plumbing to provide breathable air therethrough in the event of a fire. Such a system provides an enclosed bathroom as a small, temporary sanctuary from smoke. This may be inadequate, however, in large, heavily populated buildings where there may only be a few bathrooms, such as, for example, an airport terminal, government building, or school. Moreover, smoke has an odor and can be seen, thus people can respond accordingly. Many chemical and biological toxins, on the other hand, are odorless and invisible, so it may be difficult to quickly alert everyone of the danger and the appropriate action to take.

SUMMARY OF THE INVENTION

To effectively respond to a building's breathable air becoming contaminated with biological or chemical toxins, it is an object of the invention to provide an emergency ventilation system that is readily added to an existing building.

A second object is to provide an emergency ventilation system that broadly covers the inside of a building as opposed to being limited to certain areas, such as a bathroom.

A third object is to provide an emergency ventilation system that does not rely on a building's existing ductwork to supply life-sustaining air, as such existing ductwork may itself be contaminated.

A fourth object is to deliver emergency life-sustaining air through a conduit that was just previously filled with water, so that the conduit being filled with water helps prevent contaminants from entering the conduit prior to it being used to convey air.

A fifth object is to provide a dual-purpose emergency system that is responsive to fires as well as contaminated air.

A sixth object of the invention is to provide a discharge valve system with a float valve that is normally closed when the supply lines are filled with water, and then automatically opens when the lines are drained, thus providing an outlet for life-sustaining air.

These and other objects of the invention are provided by a dual-emergency response system that includes a common supply line that selectively conveys a fire extinguishing fluid to extinguish a fire and conveys life-sustaining air to displace contaminated air.

DESCRIPTION OF THE PREFERRED EMBODIMENT

Figure 1:
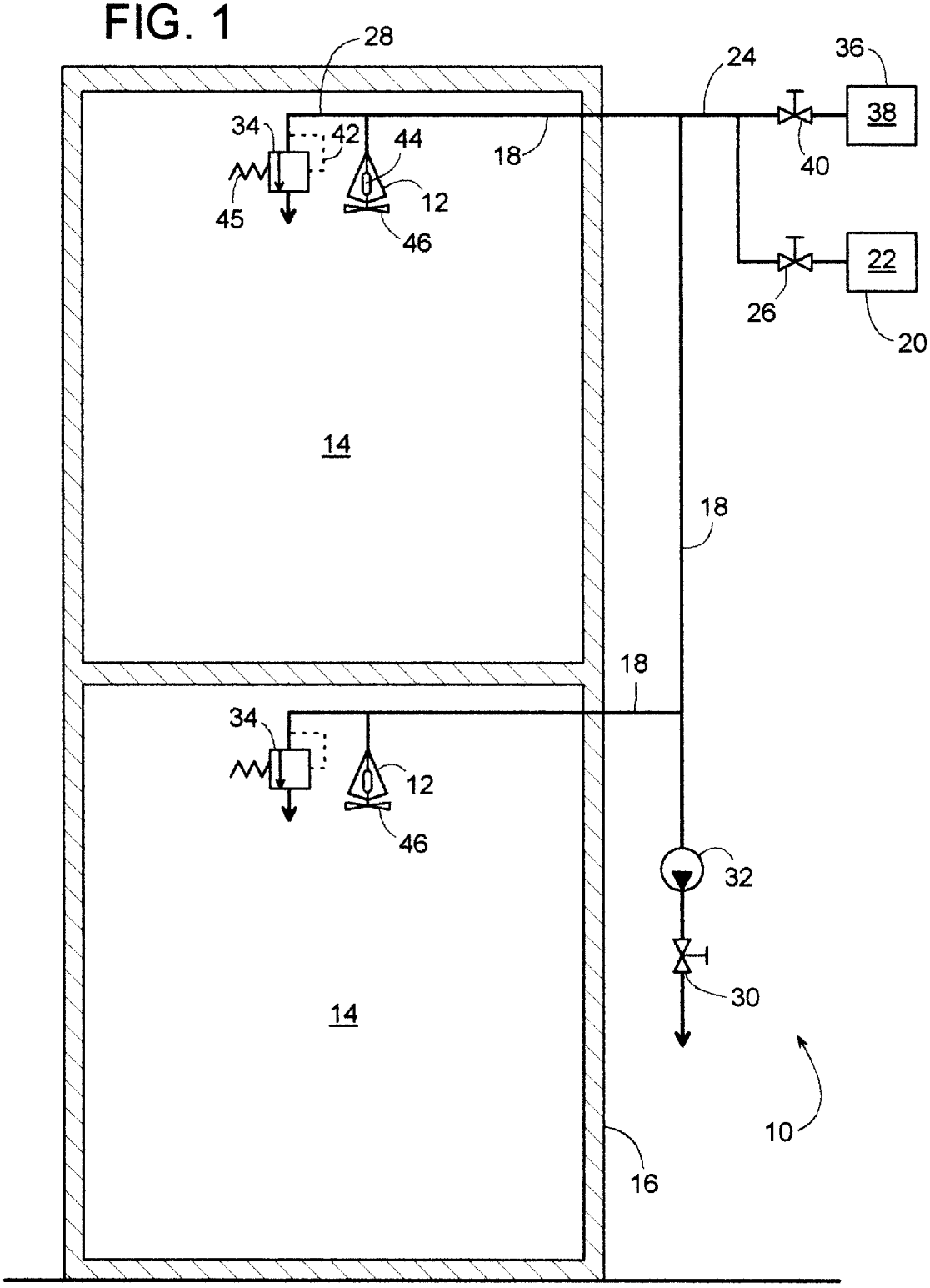
FIG. 1, is a schematic cross-sectional view of a building with a dual-emergency response system that includes a pressure responsive valve disposed alongside a fire extinguishing spray head.

In FIG. 1, a dual-emergency response system 10 is shown installed in a two-story building 16. System 10 includes a conventional overhead fire extinguishing spray head 12 installed in an upper and a lower room 14. A pipe serves as common supply line 18 that couples spray head 12 to a supply 20 of fire extinguishing fluid 22 such as water. However, other chemical fire extinguishing fluids, both liquid and gaseous, could also be used, and some examples would include, but not be limited to, carbon dioxide or halogen gas. In this example, supply 20 is simply a municipal water main. Line 18 has an inlet 24 coupled to supply 20 by way of a valve 26. An outlet 28 in fluid communication with inlet 24 is coupled to supply water 22 to each spray head 12. A drain valve 30 provides a way to drain supply line 18, and an optional pump 32 in series flow relationship with valve 30 speeds up the draining process.

A pressure sensitive valve 34 is connected to each outlet 28, and is used in conjunction with a source of oxygen 36 in the event that the protected areas, i.e., rooms 14 become contaminated with a biological or chemical toxin. In this example, oxygen source 36 is simply a fan or compressor that forces fresh outdoor air (of which oxygen is a component) to outlet 28 by way of a valve 40 and common supply line 18. Pressure sensitive valve 34 includes a pressure sensing line 42 that opposes a spring 45 to urge valve 34 to a closed state. Valve 34 is similar to a pressure regulator (installed backwards) in that it changes from being closed to an open state when its pressure sensing line 42 senses the fluid pressure at outlet 28 dropping below a predetermined lower limit. A conventional pressure regulator senses the downstream pressure, while valve 34 senses the upstream pressure. The actual value of the predetermined lower limit can vary depending on the application. But for this example, it is set at 35 psig (i.e., 35 pounds per square inch above atmospheric) to accommodate a 60 psig water pressure at supply 20 and 30 psig of air pressure at oxygen source 36.

In a standby, non-emergency mode, valves 30 and 40 are closed and valve 26 is open to fill supply line 18 with water. To prevent water from discharging into the rooms, valves 34 and spray heads 12 are closed. Each spray head 12 includes an alloy plug 44 having a rather low melting temperature, so fire readily melts plug 44 to open spray head 12. In this embodiment, valves 26 and 40 provide what is referred to as a supply valve system, while valve 34 and spray head 12 provide what is referred to as a discharge valve system.

In the event that fire melts plug 44 of one of the spray heads 12, that spray head 12 opens to discharge water across a diffuser 46 to extinguish the fire below, thereby operating as a conventional fire sprinkler system. The supply valve system (valves 26 and 40) are in a fire responsive state with valve 26 open and valve 40 closed.

In the event that the air in one or more of rooms 14 becomes contaminated with hazardous biological or chemical toxins, the dual-emergency response system 10 can be started simply by the manual manipulation of valves or automatically in response to an appropriate sensor. Specific details of an actual sensor would vary widely, as they would depend on the wide variety of potential toxins. To start system 10, water supply valve 26 closes and drain valve 30 opens to drain the water from supply line 18. Pump 32 can be started to speed the draining process. When the pressure in line 18 drops below 35 psig, valves 34 naturally open to vent line 18 at each outlet 28 to further promote draining. Once line 18 is generally drained, the supply valve system switches to a contaminated air state, wherein valve 40 opens and valve 26 closes. Valve 40 being open delivers 30 psig fresh air to each pressure sensitive valve 34 via line 18. Since 30 psig is insufficient to close either valve 34, they remain open to discharge the fresh air into each room 14; thereby diluting the contaminated air or displacing it out through windows or the building's existing air ducts.

It should be appreciated by those skilled in the art, that valves 26, 30 and 40 can be manually operated as needed or power operated by a variety of actuators including, but not limited to, solenoids, electric motor actuators, and hydraulic or pneumatic actuation. Power actuators, in turn, can be controlled by conventional control circuits including, but not limited to, relay circuits and programmable logic controllers (commonly referred to as a PLC). It should also be noted that valve 40 could simply be a check valve, whereby it would be held closed when 60 psig water pressure was acting upon it, and automatically opens when valve 26 shuts and drain valve 30 opens.

Although system 10 has been described as what can be referred to as a "wet system" where line 18 remains filled with water while in a standby mode, system 10 can also be operated in what can be referred to as a "dry system." In a dry system, line 18 is left drained of its water while in its standby mode to prevent line 18 from freezing in a building having no heat, such as in some warehouses. When operated as a dry system, valves 26 and 40 are left closed in standby. When a fire occurs, valve 26 opens to supply line 18 with water, and alternately when there is toxic air contamination, valve 40 opens to deliver fresh air.

Figure 2:
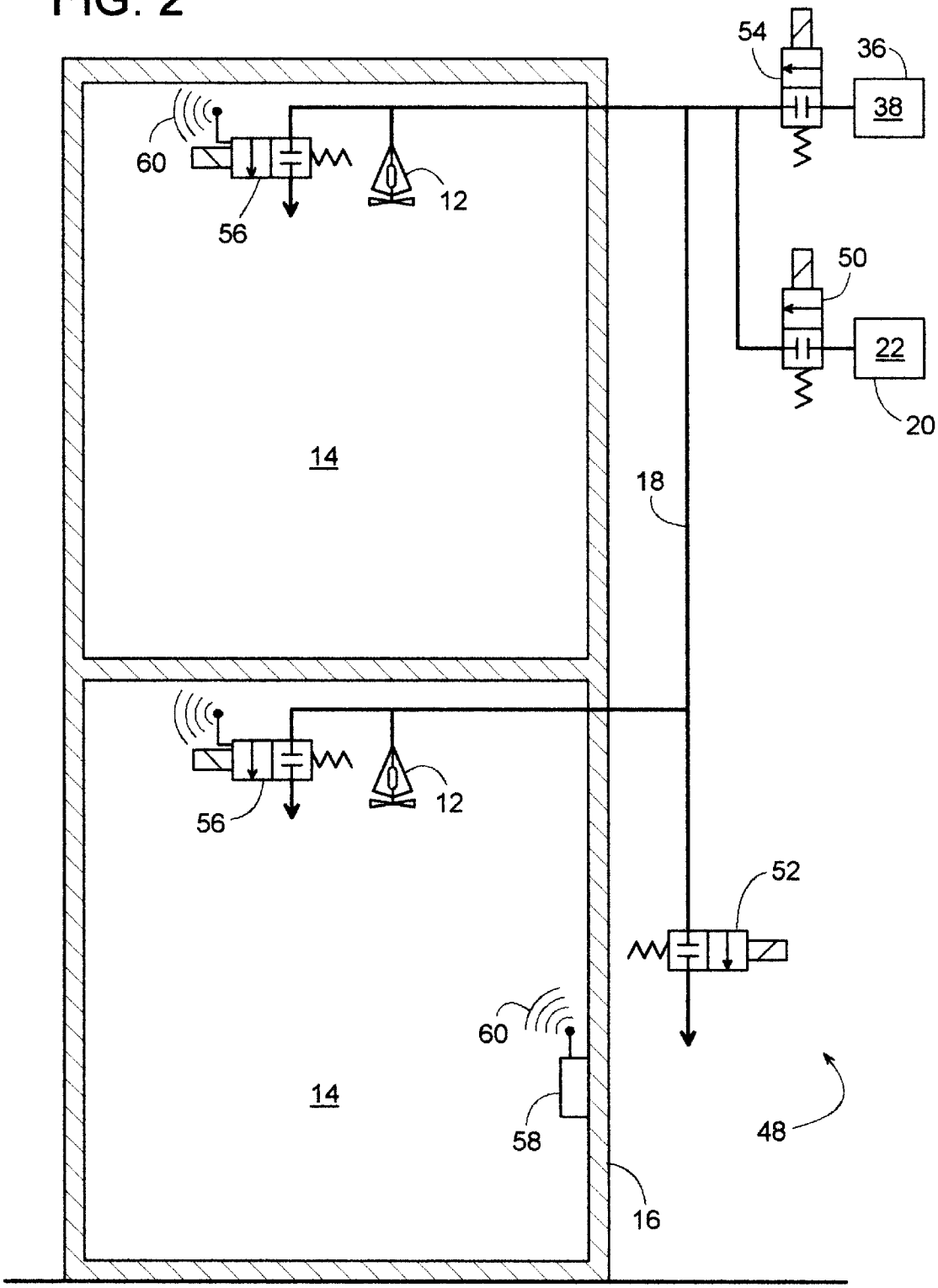
FIG. 2, is a schematic cross-sectional view of a building with another embodiment of a dual-emergency response system.

In a similar system 48, shown in FIG. 2, pump 32 is eliminated; valves 26, 30 and 40 are replaced by solenoid actuated valves 50, 52 and 54 respectively; and pressure sensitive valves 34 are replaced by solenoid actuated valves 56. In a standby mode valve 50 is open; valves 54, 52 and 56 are closed; and supply line 18 is filled with water. In the event of a fire, valve 50 being open delivers water from supply 20, through line 18 and out through which ever spray head 12 is open to extinguish the fire.

In the event of biological or chemical air contamination, line 18 is drained by closing valve 50 and opening drain valve 52. Also, in this example, valves 56 are triggered to open by radio waves 60 generated by a manually operated control transmitter 58. It is not necessary to have a separate transmitter for every valve 56, as any one transmitter 58 actuates all the valves as a group. However, there should be enough transmitters distributed within the building to actuate the system from a number of convenient and readily accessible locations, as is often the case with pull-style fire alarms. Opening valves 56 vents supply line 18 so it drains faster. After much of the water is drained from line 18, valve 54 opens to deliver fresh air 38 to rooms 14 via open valves 56. Just as with the embodiment of FIG. 1, system 48 can be operated as a wet or dry system, and the solenoid valves can be controlled by any one of a variety of conventional control circuits.

Figure 3:
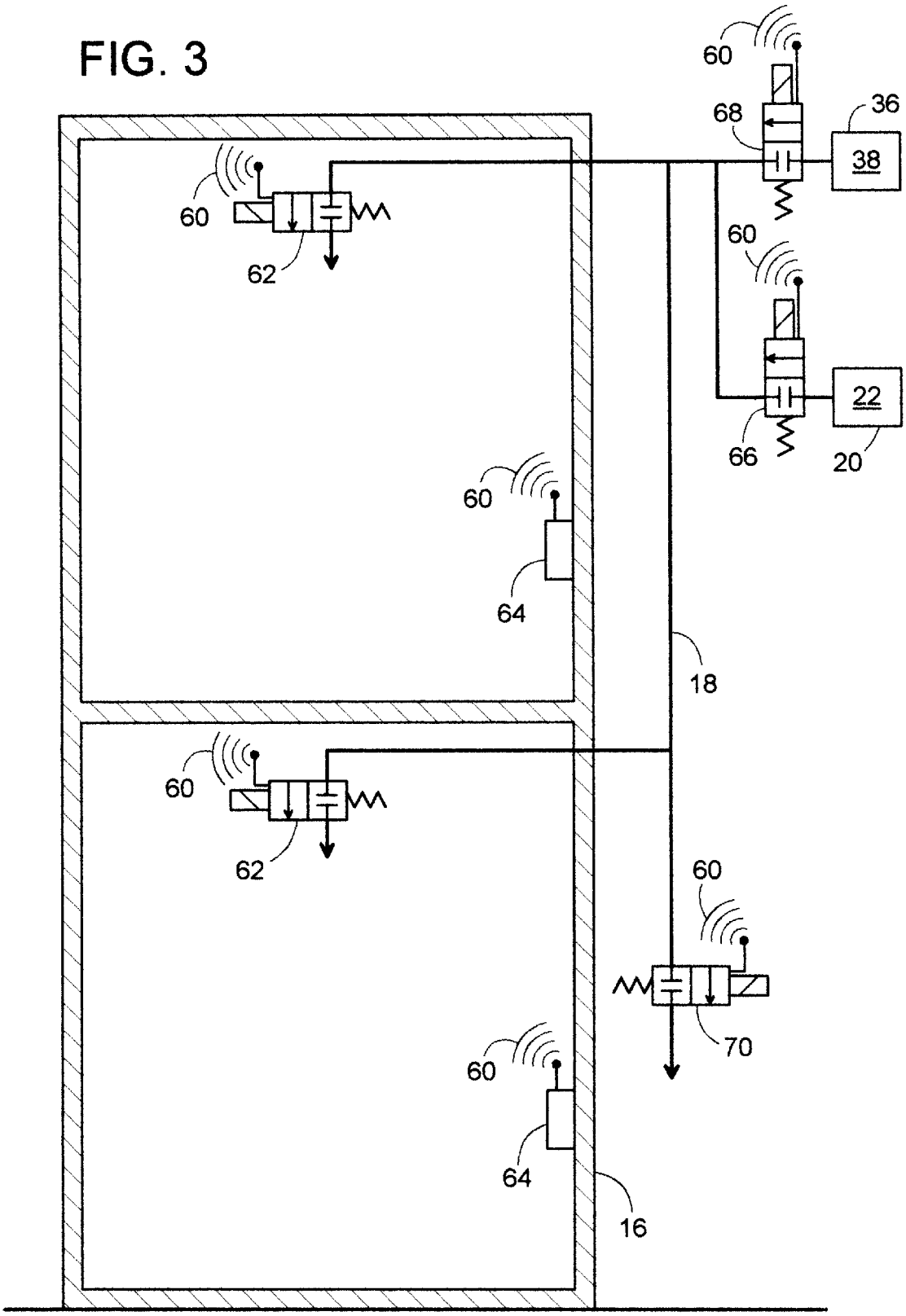
FIG. 3, is a schematic cross-sectional view of a building with another embodiment of a dual-emergency response system.

If desired conventional spray heads 12 of system 48 can be eliminated, as shown in the embodiment of FIG. 3. In this example, each room or protected area 14 within the building, has a solenoid valve 62 independently triggered by radio signals 60 (or some other electrical connection) emitted by its own designated transmitter 64. Each transmitter 64 includes a conventional fire or smoke detector that upon sensing signs of a fire, opens its respective valve 62, while leaving other valves 62 shut. A water supply valve 66 is opened by radio signals 60 or some other conventional signal to deliver water to the fire. In the event of air in the building becoming contaminated with toxins, manually triggering any transmitter 64, generates radio signals 60 that control valves 66, 68, 70 and 62 in the same way that valves 50, 54, 52 and 56 are operated in the embodiment of FIG. 2.

Figure 4:
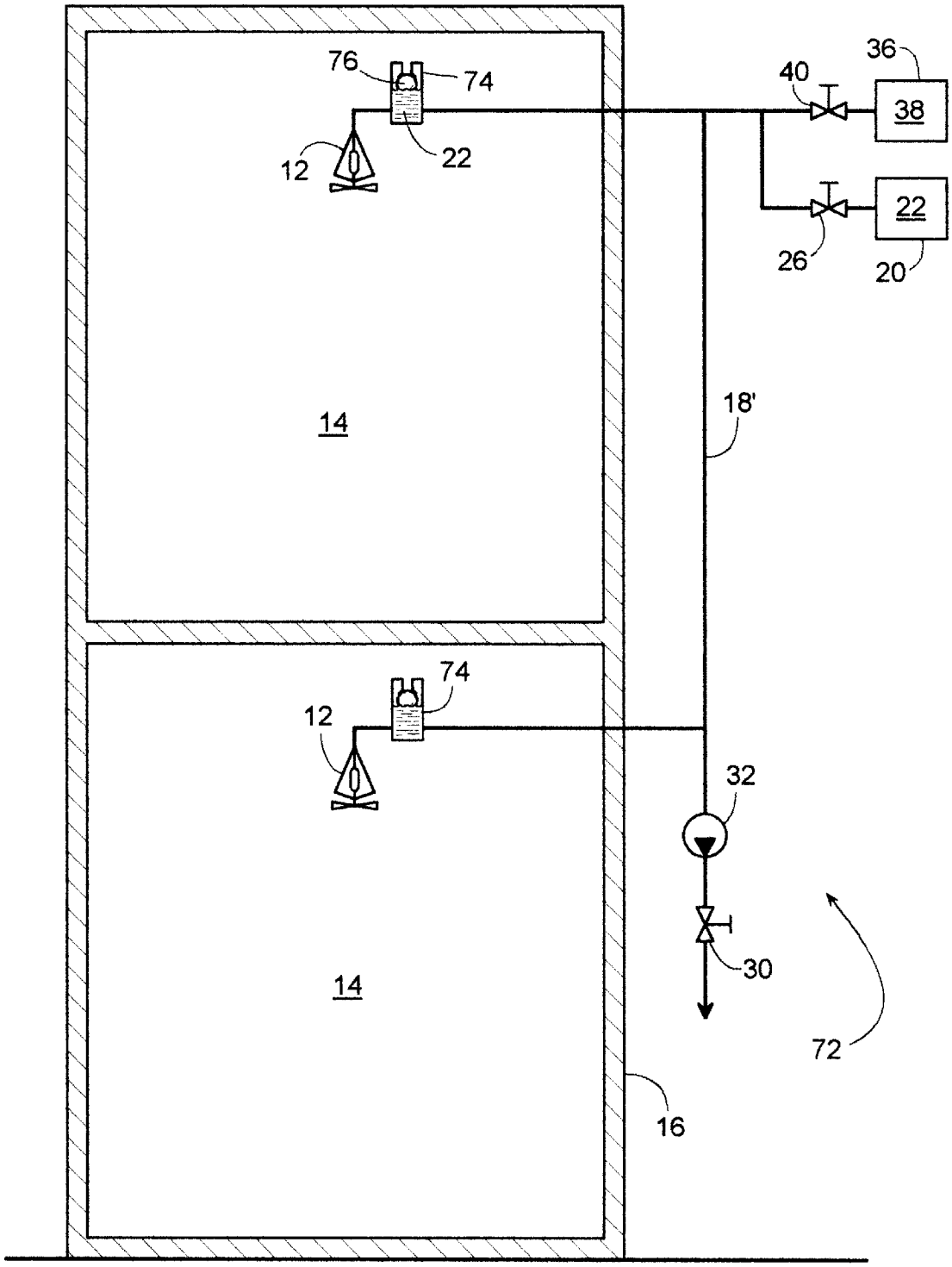
FIG. 4, is a schematic cross-sectional view of a building with another embodiment of a dual-emergency response system.
Figure 5:
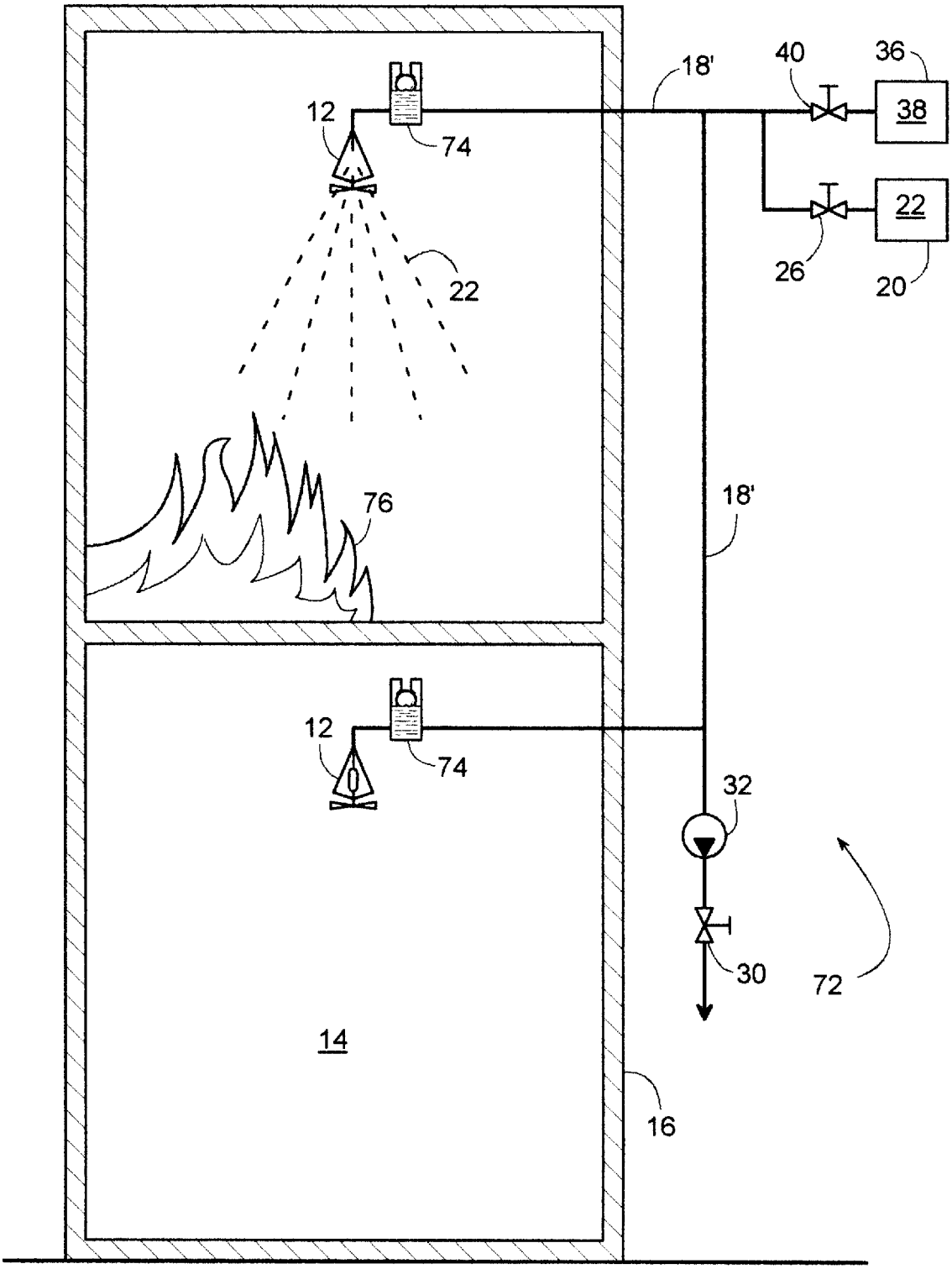
FIG. 5, is a schematic cross-sectional view of a building showing the embodiment of FIG. 4 extinguishing a fire.
Figure 6:
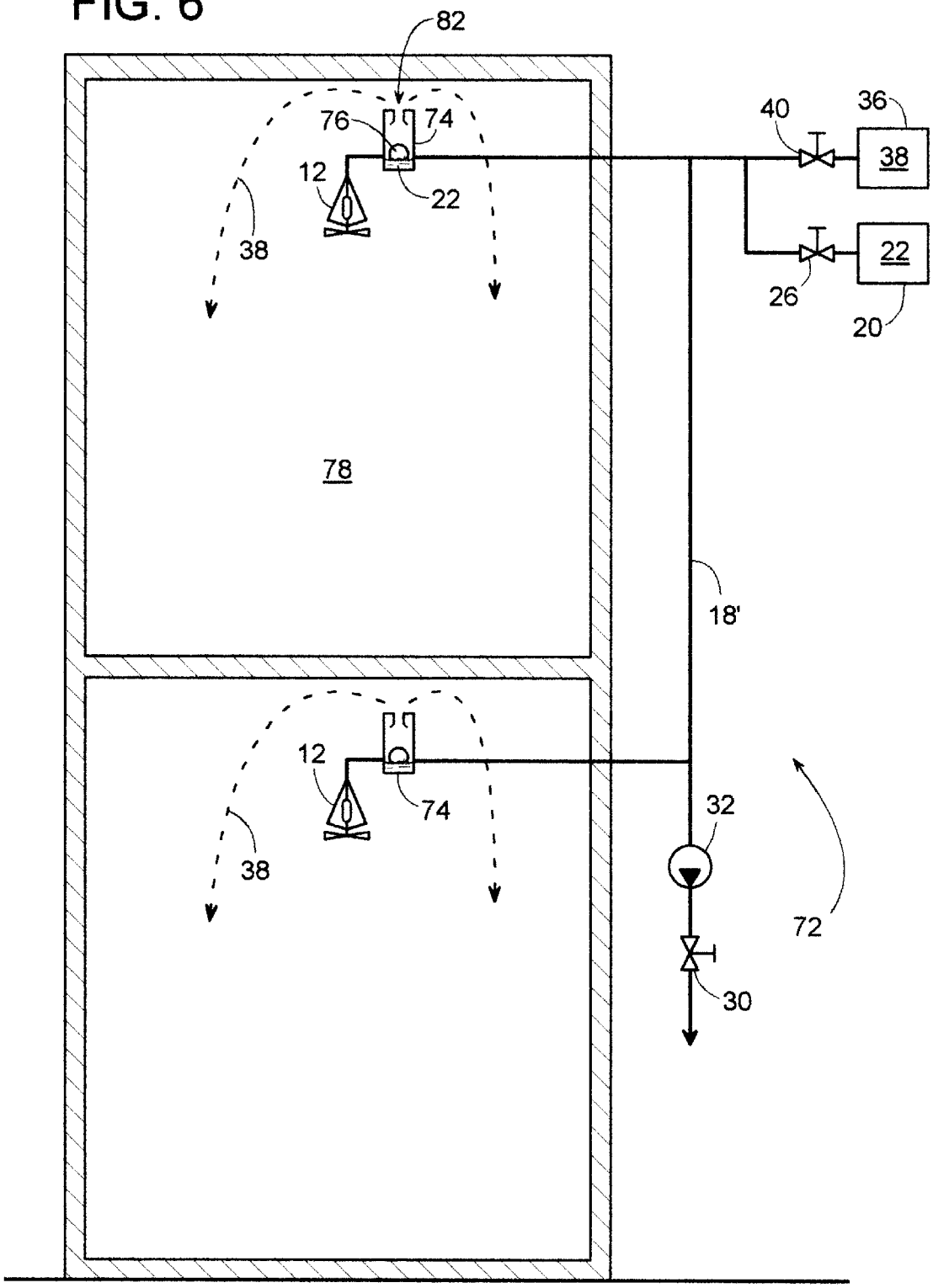
FIG. 6, is a schematic cross-sectional view of a building showing the embodiment of FIG. 4 displacing air contaminated by toxins.

Another system 72, of FIGS. 4–6, is similar to that of FIG. 1, but a float valve 74 replaces pressure sensitive valve 34. Valve 74 includes a float 76 that closes valve 74 in the presence of water 22 or some other fire extinguishing liquid. When operated as a wet system, valve 74 is shut during standby (see FIG. 4) and is also shut when water 22 is being conveyed through a supply line 18' and discharging through spray head 12 to extinguish a fire 76 (see FIG. 5). When there is contaminated air 78 present (see FIG. 6), water supply valve 26 closes, drain valve 30 opens and pump 32 starts to rapidly drain system 72 of its water 22. This causes the water level in float valves 74 to drop, which allows float 76 to fall away from and thus open an air outlet 82 of valve 74. Placing the supply valve system in a contaminated air state (i.e., closing valve 26 and opening valve 40) delivers life-sustaining air 38 to float valve 74. Air 38 then discharges through outlet 82 to displace the contaminated air 78. Just as with the embodiment of FIG. 1, system 72 can be operated as wet or dry system.

Although the invention is described with respect to a preferred embodiment, modifications thereto will be apparent to those skilled in the art. Therefore, the scope of the invention is to be determined by reference to the claims, which follow.

We claim:

1. A dual-emergency response system to protect an area within a building, said dual-emergency response system being operative in conjunction with a supply of a fire extinguishing fluid and a source of oxygen to respectively respond to a fire and also to air contaminated with a toxin, said system comprising:

a common supply line adapted to be fixed relative to said building and having an inlet and an outlet in fluid communication with each other, said common supply line being adapted to convey both said fire extinguishing fluid and said oxygen between said inlet and said outlet;

a supply valve system selectively having a fire responsive state and a contaminated air state and being coupled to said inlet, said supply of said fire extinguishing fluid, and said source of oxygen, wherein said fire responsive state places said fire extinguishing fluid in fluid communication with said inlet while closing off said source of oxygen and wherein said contaminated air state places said oxygen in fluid communication with said inlet while closing off said fire extinguishing fluid; and a plurality of overhead discharge valve systems adapted to be fixed relative to said building and each having an open state and a closed state to selectively place said outlet in fluid communication with said protected area, whereby if said fire is in said area, said supply valve system in said fire responsive state and at least one of said overhead discharge valve systems are in said open state, then said dual-emergency response system places said fire extinguishing fluid in fluid communication with said area to extinguish said fire, and if said toxin is in said area, said supply valve in said contaminated air state and at least one of said plurality of overhead discharge valve systems are in said open state, then said dual-emergency response system places said oxygen in fluid communication with said area to displace said toxin.

2. The dual-emergency response system of claim 1, wherein said plurality of overhead discharge valve systems includes a plug that melts to place said plurality of overhead discharge valve systems in said open state.

3. The dual-emergency response system of claim 2, wherein said plurality of overhead discharge valve systems includes a diffuser disposed below said plug to diffuse said fire extinguishing fluid upon discharging from said plurality of overhead discharge valve systems.

4. The dual-emergency response system of claim 1, wherein said plurality of overhead discharge valve systems includes a pressure sensitive valve that opens upon a fluid pressure in said common supply line dropping below a predetermined limit, thereby placing said plurality of overhead discharge valve systems in said open state.

5. The dual-emergency response system of claim 4, wherein said predetermined limit is between a first pressure at which said common supply line conveys said fire extinguishing fluid and a second pressure at which said common supply line conveys said oxygen.

6. The dual-emergency response system of claim 1, wherein said plurality of overhead discharge valve systems includes a solenoid valve.

7. The dual-emergency response system of claim 6, wherein said solenoid valve is triggered to actuate between an open position and a closed position in response to a radio wave signal.

8. The dual-emergency response system of claim 1, wherein said fire extinguishing fluid is a liquid and said plurality of overhead discharge valve systems includes a float valve that closes upon a liquid level of said fluid therein exceeding a predetermined limit.

9. The dual-emergency response system of claim 1, wherein said oxygen is provided as a component of air.

10. The dual-emergency response system of claim 1, wherein said fire extinguishing fluid is a gas.

11. The dual-emergency response system of claim 10, wherein said gas includes carbon dioxide.

12. The dual-emergency response system of claim 10, wherein said gas includes halogen.

13. The dual-emergency response system of claim 1, further comprising a drain valve coupled to said common supply line and disposed at an elevation below said plurality of overhead discharge valve systems to drain said fire extinguishing fluid from said dual-emergency response system to facilitate conveying said oxygen through said common supply line and into said plurality of overhead discharge valve systems.

14. The dual-emergency response system of claim 13, further comprising a pump in series flow relationship with said drain valve to pump draining said fire extinguishing fluid from said dual-emergency response system.

15. A dual-emergency response system to protect an area within a building, said dual-emergency response system being operative in conjunction with a supply of water and a source of life-sustaining air to respectively respond to a fire and also to air contaminated with a toxin, said system comprising:

a common supply line adapted to be fixed relative to said building and having an inlet and an outlet in fluid communication with each other, said common supply line being adapted to convey both said water and said life-sustaining air between said inlet and said outlet;

a supply valve system selectively having a fire responsive state and a contaminated air state and being coupled to said inlet, said supply of said water, and said source of life-sustaining air, wherein said fire responsive state places said water in fluid communication with said inlet while closing off said source of life-sustaining air, and wherein said contaminated air state places said life-sustaining air in fluid communication with said inlet while closing off said source fire extinguishing fluid;

a plurality of overhead discharge valve systems adapted to be fixed relative to said building and each having an open state and a closed state to selectively place said outlet in fluid communication with said protected area, whereby if said fire is in said area, said supply valve system in said fire responsive state, and at least one of said plurality of said discharge valve systems is in said open state, then said dual-emergency response system places said water in fluid communication with said area to extinguish said fire, and if said toxin is in said area, said supply valve in said contaminated air state, and at least one of said plurality of overhead discharge valve systems is in said open state, then said dual-emergency response system places said life-sustaining air in fluid communication with said area to displace said toxin; and a float valve included in said plurality of overhead discharge valve systems, said float valve closing upon a liquid level of said water therein exceeding a predetermined limit.

16. The dual-emergency response system of claim 15, wherein said plurality of overhead discharge valve systems includes a plug that melts to place said plurality of overhead discharge valve systems in said open state.

17. The dual-emergency response system of claim 15, further comprising a pump and a drain valve in series flow relationship with each other and coupled to said common supply line and disposed at an elevation below said plurality of overhead discharge valve systems to pump said water from said dual-emergency response system to facilitate conveying said life-sustaining air through said common supply line and onto said discharge valve system.

18. A dual-emergency response system to protect an area within a building, said dual-emergency response system being operative in conjunction with a supply of a water and a source of life-sustaining air to respectively respond to a fire and also to air contaminated with a toxin, said system comprising:

a common supply line adapted to be fixed relative to said building and having an inlet and an outlet in fluid communication with each other, said common supply line being adapted to convey both said water and said life-sustaining air between said inlet and said outlet;

a supply valve system selectively having a fire responsive state and a contaminated air state and being coupled to said inlet, said supply of water, and said source of life-sustaining air, wherein said fire responsive state places said water in fluid communication with said inlet while closing off said source of life-sustaining air, and wherein said contaminated air state places said life-sustaining air in fluid communication with said inlet while closing off said supply of water;

a pump and a drain valve in series flow relationship with each other and coupled to said common supply line and disposed at an elevation suitable to pump most of said water from said common supply line to facilitate conveying said life-sustaining air through said common supply line and onto said outlet;

a plurality of overhead water spray heads adapted to be fixed relative to said building and each being coupled to said outlet, each of said plurality of overhead water spray heads being normally closed by a plug that upon melting opens at least one of said plurality of water spray heads to place said outlet in fluid communication with said area; and a plurality of overhead air delivery valves coupled to said outlet, each of said plurality of overhead air delivery valves having an open position to deliver said life-sustaining air into said area and a closed position to inhibit water from discharging therethrough.

19. The dual-emergency response system of claim 18, wherein said plurality of overhead air delivery valves change between said open position and said closed position in response to a fluid pressure in said common supply line.

20. The dual-emergency response system of claim 18, further comprising a float that closes at least one of said plurality of air delivery valves in response to a level of water associated with said float exceeding a predetermined limit.

* * * * *